US011111116B2

(12) United States Patent
Dow et al.

(10) Patent No.: US 11,111,116 B2
(45) Date of Patent: Sep. 7, 2021

(54) WINCH WITH HANDHELD BATTERY POWERED TENSIONING AND PAYOUT UNIT AND METHOD AND APPARATUS FOR RETROFITTING MANUAL WINCHES

(71) Applicant: Dow Solutions, LLC., Pittsburgh, PA (US)

(72) Inventors: Justin Dow, Monroeville, PA (US); Erik Arlet, Pittsburgh, PA (US)

(73) Assignee: DOW SOLUTIONS, LLC., Pittsburgh, PA (US)

( * ) Notice: Subject to any disclaimer, the term of this patent is extended or adjusted under 35 U.S.C. 154(b) by 218 days.

(21) Appl. No.: 16/387,459

(22) Filed: Apr. 17, 2019

(65) Prior Publication Data

US 2019/0315608 A1 Oct. 17, 2019

Related U.S. Application Data

(60) Provisional application No. 62/658,879, filed on Apr. 17, 2018.

(51) Int. Cl.
*B66D 1/14* (2006.01)
*B66D 1/12* (2006.01)
*B66D 1/04* (2006.01)

(52) U.S. Cl.
CPC ..... *B66D 1/14* (2013.01); *B66D 1/04* (2013.01); *B66D 1/12* (2013.01); *B66D 2700/0141* (2013.01)

(58) Field of Classification Search
CPC ..... B66D 1/04; B66D 1/06; B66D 1/7478; B66D 1/12; B66D 1/14; B66D 2700/0141
See application file for complete search history.

(56) References Cited

U.S. PATENT DOCUMENTS

| | | | | |
|---|---|---|---|---|
| 3,490,547 | A * | 1/1970 | Stewart | B25F 3/00 173/29 |
| 4,236,694 | A | 12/1980 | Kristensson | |
| 4,566,674 | A | 1/1986 | Ebey et al. | |
| 4,703,917 | A | 11/1987 | Tomlinson | |
| D315,976 | S | 4/1991 | Shieh | |
| 5,048,799 | A | 9/1991 | Aronowitsch et al. | |
| 5,374,035 | A | 12/1994 | Santos | |
| 5,607,143 | A * | 3/1997 | Regal | B66D 1/04 254/342 |
| 5,947,450 | A | 9/1999 | Grapes | |
| 6,431,525 | B1 | 8/2002 | Roll | |
| 6,705,597 | B1 * | 3/2004 | Reilly | B60P 7/0846 254/223 |
| 7,128,307 | B2 * | 10/2006 | Dow | B66D 1/04 254/342 |
| 7,278,808 | B1 * | 10/2007 | Sisk, Sr. | B60P 7/0853 279/144 |

(Continued)

FOREIGN PATENT DOCUMENTS

| | | | | |
|---|---|---|---|---|
| GB | 2317844 A * | 4/1998 | | B66D 1/7478 |

*Primary Examiner* — Emmanuel M Marcelo

(74) *Attorney, Agent, or Firm* — Blynn L. Shideler; Krisanne Shideler; BLK Law Group

(57) ABSTRACT

A winch with handheld battery powered tensioning and payout unit provides uniform loading of all winches and allows for safe easy loading and payout. A method and apparatus is provided for retrofitting manual winches, in particular manual marine winches, to be operable with a handheld battery powered tensioning and payout unit.

15 Claims, 3 Drawing Sheets

(56) References Cited

U.S. PATENT DOCUMENTS

| | | | | |
|---|---|---|---|---|
| 7,410,336 | B2 * | 8/2008 | Parks | B60P 7/0846 279/144 |
| 7,644,906 | B2 * | 1/2010 | Rodrigue | B65H 54/585 254/242 |
| D682,073 | S * | 5/2013 | Payne | D8/359 |
| 8,720,865 | B2 | 5/2014 | Anderson et al. | |
| 9,004,456 | B2 | 4/2015 | Topping, Jr. et al. | |
| 9,915,290 | B2 * | 3/2018 | Wilkinson | F16D 1/112 |
| 10,088,016 | B2 * | 10/2018 | Bujold | B60P 7/0853 |
| D842,063 | S * | 3/2019 | DeBellis | D8/70 |
| 2004/0007701 | A1 * | 1/2004 | Goulet | B66D 1/08 254/213 |
| 2008/0263837 | A1 * | 10/2008 | Cumbers | B60P 7/083 24/68 CD |
| 2011/0079967 | A1 * | 4/2011 | Presley | B25F 3/00 279/145 |
| 2011/0101144 | A1 * | 5/2011 | Denning | B65H 54/585 242/390 |
| 2015/0190916 | A1 * | 7/2015 | Bergman | B66D 1/12 279/145 |
| 2018/0179018 | A1 * | 6/2018 | Henderson | B60P 7/0846 |

* cited by examiner

WINCH WITH HANDHELD BATTERY POWERED TENSIONING AND PAYOUT UNIT AND METHOD AND APPARATUS FOR RETROFITTING MANUAL WINCHES

RELATED APPLICATION

This application claims the benefit of Provisional Patent Application 62/658,879 filed Apr. 17, 2018 titled "Winch with Handheld Battery Powered Tensioning and Payout Unit and Method and Apparatus for Retrofitting Manual Winches" which is incorporated herein by reference.

BACKGROUND OF THE INVENTION

1. Field of the Invention

We, Justin Dow and Erik Arlet, have developed a new winch design and apparatus for and method of retrofitting existing winches. The present invention relates to winch with handheld battery powered tensioning and payout unit and method and apparatus for retrofitting manual winches.

2. Background Information

A winch is a mechanical device that is used to pull in (wind up) or let out (wind out) or otherwise adjust the "tension" of a rope or wire rope (also called "cable" or "wire cable"). In its simplest form, it consists of a drum or spool and attached hand crank. In larger forms, winches stand at the heart of machines as diverse as tow trucks, steam shovels and elevators. Many winches have gear assemblies and can be powered by electric, hydraulic, pneumatic or even internal combustion drives. Some may include a solenoid brake and/or a mechanical brake or ratchet and pawl device that prevents it from unwinding unless the pawl is retracted.

The earliest literary reference to a winch can be found in the account of Herodotus of Halicarnassus on the Persian Wars (Histories 7.36), where he describes how wooden winches were used to tighten the cables for a pontoon bridge across the Hellespont in 480 B.C. Thus cable tensioning winches have been utilized for several millennium.

Manual winches have long been used where power is not easily accessible. Examples of manual winches are shown in U.S. Pat. Nos. 4,236,694, 4,703,917, D315,976, 5,048,799, 5,374,035 and 8,720,865 which are incorporated herein by reference. One area of common usage of manual winches where power is not always easily accessible is marine winches often used for coupling barges. Examples of such marine winches for barge connection are shown in U.S. Pat. Nos. 4,566,674, 5,947,450, 6,431,525, and 9,004,456. Manual marine winches for barge connections typically are under considerable tension.

It would be beneficial to have a winch with handheld battery powered tensioning and payout unit for application where power is not easily accessible.

SUMMARY OF THE INVENTION

Figure 1:
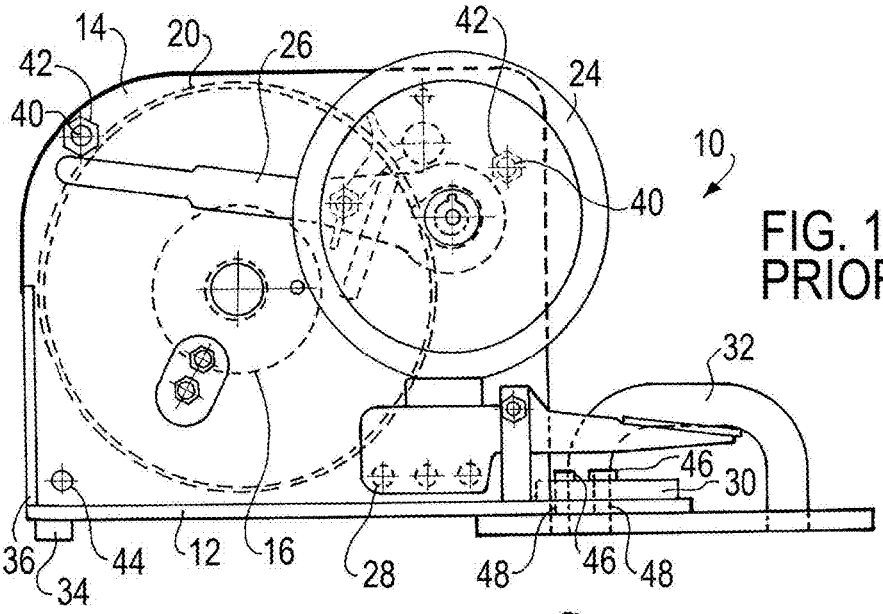
FIG. 1 PRIOR ART
FIG. 1 is a side elevation view of a known prior art winch which can implement the present invention.

It is an object of the present invention to provide an effective and efficient winch with handheld battery powered tensioning and payout unit. The handheld battery powered tensioning and payout unit provides uniform loading of all winches and allows for safe easy loading and payout. A winch according to one aspect of the invention provides a housing with side plates; a rotatable spool assembly supported between the side plates on a drum shaft and including a drum upon on a drum shaft on which the winch line is spooled and unspooled and a controlling gear on the drum shaft cooperating with the drum; a control assembly supported by the side plates on a control shaft and engaging with the controlling gear to rotate the drum for spooling of the winch line on and off and holding the tension on the winch; a torque plate coupled to the control shaft and having at least one drive socket, wherein rotation of the torque plate causes rotation of the control shaft and of the controlling gear and the drum, a handheld battery operated powered tensioning and payout unit having at least one socket drive member matching the at least one drive socket of the torque plate, wherein operation of the unit when the at least one socket drive member is received within the at least one drive socket of the torque plate causes rotation of the torque plate and consequent spooling or unspooling of the winch line on the drum.

The winch according to one aspect of the invention may provide wherein the control assembly extends through one side plate and includes a hand wheel on the control shaft used for manually operating the winch and wherein the control assembly includes an actuating lever which cooperate with the control shaft used for manually operating the winch.

The winch according to one aspect of the invention may provide wherein the torque plate is coupled to the hand wheel. The winch according to one aspect of the invention may provide wherein the torque plate is keyed onto the control shaft.

The winch according to one aspect of the invention may provide wherein the torque plate includes one central drive socket and another aspect provides wherein the torque plate includes an annular array of drive sockets.

The winch according to one aspect of the invention may provide wherein the handheld battery operated powered tensioning and payout unit includes a reaction arm configured to extend from the unit and prevent rotation of the unit during rotation of the torque plate and wherein the reaction arm of the handheld battery operated powered tensioning and payout unit includes a stop engaging with the housing of the winch, wherein a side plate incudes a recess engaging the stop of the reaction arm.

An object of the present invention provides an apparatus for retrofitting manual winches which may include a torque plate configured to be coupled to a control shaft of a manual winch and having at least one drive socket, wherein rotation of the torque plate once coupled to the control shaft would be configured to cause rotation of the control shaft and of a controlling gear and a drum of the winch, and a handheld battery operated powered tensioning and payout unit having at least one socket drive member matching the at least one drive socket of the torque plate, wherein operation of the unit when the at least one socket drive member is received within the at least one drive socket of the torque plate and the torque plate has been coupled to a control shaft of a manual winch, causes rotation of the torque plate and consequent spooling or unspooling of the winch line on the drum.

It is an object of the present invention to provide an effective and efficient method and apparatus for retrofitting manual winches to be operable with handheld battery powered tensioning and payout unit. A method for retrofitting manual winches to be operable with handheld battery powered tensioning and payout unit comprising the steps of: coupling a torque plate having at least one drive socket to a control shaft of a manual winch whereby rotation of the torque plate once coupled to the control shaft would be configured to cause rotation of the control shaft and of a controlling gear and a drum of the winch, and providing a handheld battery operated powered tensioning and payout unit having at least one socket drive member matching the at least one drive socket of the torque plate, wherein operation of the unit when the at least one socket drive member is received within the at least one drive socket of the torque plate and the torque plate has been coupled to a control shaft of a manual winch, causes rotation of the torque plate and consequent spooling or unspooling of the winch line on the drum.

These and other advantages of the present invention will be clarified in the brief description of the preferred embodiment.

DESCRIPTION OF THE PREFERRED EMBODIMENTS

The present invention is directed to a winch 10 with a handheld battery powered tensioning and payout unit 100 and method and apparatus (described below) for retrofitting existing manual winches 10.

The advantages of the present invention are highlighted by reviewing and understanding the construction and manufacturing of a conventional prior art manual swivel winch 10 shown in FIG. 1. The winch 10 of the prior art shown includes a housing having a base plate 12 and a pair of spaced side plates 14 surrounding a rotatable spool assembly. The rotatable spool assembly is rotatably supported between the side plates 14 and includes a drum 16, a protecting flange 18 on one side of the drum 16 and a controlling winch gear 20 on the other side of the drum 16 all generally on a drum shaft. A control assembly 22, generally with a main or control shaft holding a drive gear meshing with the gear 20, is supported by the side plates 14 and engages with the winch gear 20 (such as through the drive gear) to rotate the drum 16 for spooling of a cable on and off and holding the tension on the winch 10 (the cable or winch line is not shown in FIG. 1, but shown in FIG. 4).

The control assembly 22 extends through one side plate 14 and includes a hand wheel 24 and an actuating lever 26 which co-operate with the control shaft and are used for manually operating the winch 10. Locking dogs or pawls are also part of the control assembly 22 selectively engaging a locking gear (or the drive gear) on the controlling shaft that is coupled to the controlling gear 20 (or the locking dogs may engage directly with the controlling gear 20). The locking dogs or pawls and are what holds the tension on the winch 10 in operation, which pawls must be released when paying out the line. A foot brake 28 in the embodiment shown is attached to the side plate 14 through which the control assembly 22 extends. The foot brake 28 is adapted to frictionally engage the hand wheel 24 and used generally for controlled payout of the line.

A swivel link 30 is attached to the base plate 12 at a rear of the winch 10 as shown and pivotally attaches the winch 10 to a D-ring 32 of a boat deck or the like. A step or foot 34 is attached to the underside of the base plate 12 near a forward portion of the winch 10. A gear guard 36 is attached to one of the side plates 14 on the same side as the gear 20 and is positioned in a cutout formed in the side plate 14. The gear guard 36 prevents the cable from interfering with or becoming wrapped behind the gear 20. Similarly, a flange guard 37 is attached to the other side plate 14 in a cutout formed therein. The flange guard 37 prevents the cable from being wrapped behind the flange 18. The construction of the manual swivel winch 10 includes the use of four tubular spacers 38 for spacing the side plates 14 apart. A bolt 40 extends through the center of each spacer 38 through aligned holes in the opposed side plates 14 and is secured by nuts 42. The swivel link 30 is attached to the base plate 12 by bolts 46 threaded into tapped holes 48 formed in the base plate 12. The winch 10 shown in FIG. 1 is a common type of manual winch 10 but the winches 10 in the industry can have a number of variances.

In general a manual winch 10 within the meaning of this application includes a housing with side plates 14 that houses rotatable spool assembly supported between the side plates 14 and which includes a drum 16 upon on a drum shaft which the winch line or cable is spooled. Further a manual winch 10 within the meaning of this application includes a controlling gear 20 cooperating with the drum 16 and a control assembly 22 supported by the side plates 14 on a control shaft and engaging with the gear 20 to rotate the drum 16 for spooling of a cable on and off and holding the tension on the winch.

Figure 3:
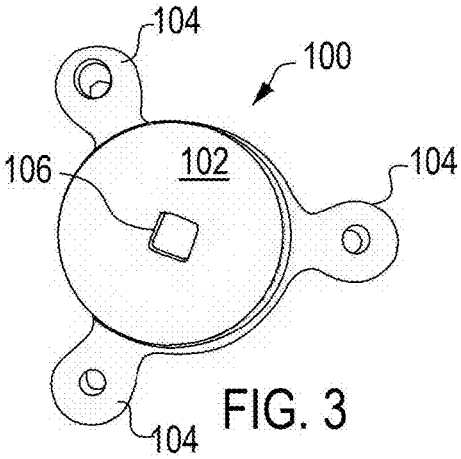
FIG. 3 is a perspective view of a torque multiplier adaptor plate according to one embodiment of the present invention.
Figure 4:
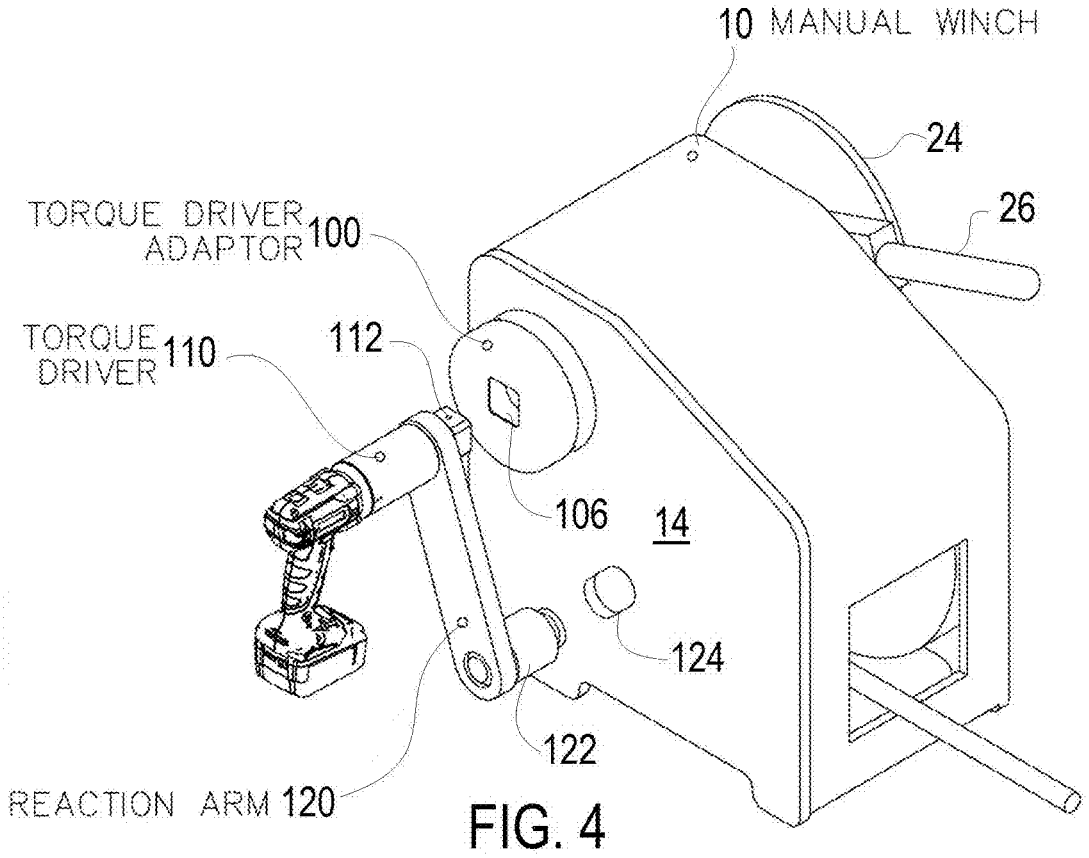
FIG. 4 is a perspective view of a winch with a handheld battery powered tensioning and payout unit according to one embodiment of the present invention.
Figure 5:
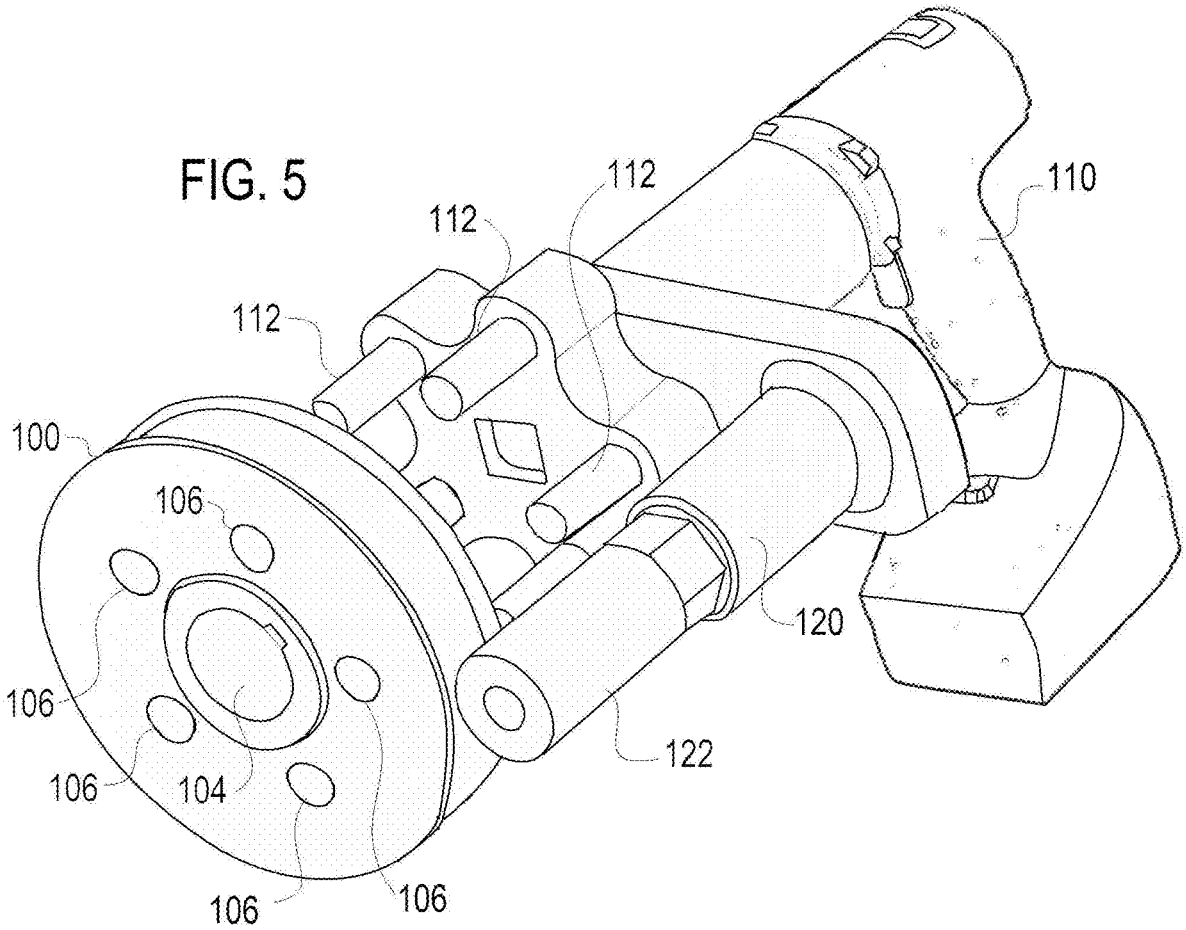
FIG. 5 is a perspective view of a torque multiplier adaptor plate with a handheld battery powered tensioning and payout unit according to one embodiment of the present invention.
Figure 6:
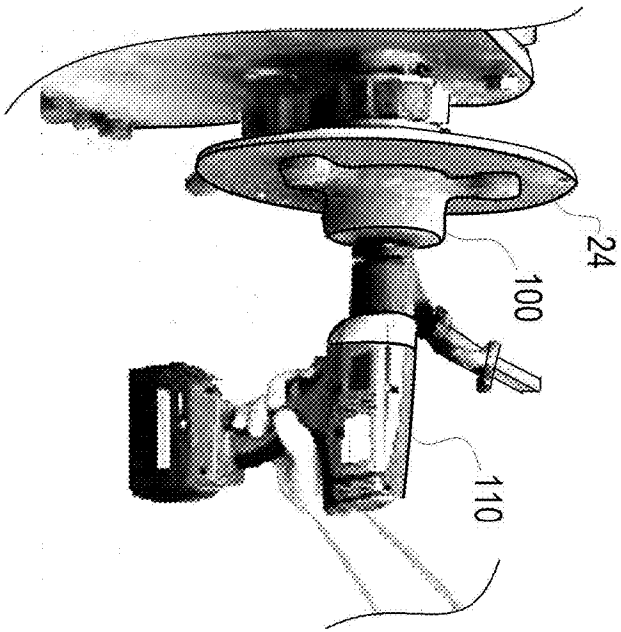
FIG. 6 is a perspective partial view of a winch with a handheld battery powered tensioning and payout unit according to one embodiment of the present invention.

A winch 10 of the present invention (as shown in FIGS. 4 and 6) may be described as a winch 10 including a housing with side plates 14; a rotatable spool assembly supported between the side plates 14 on a drum shaft and including a drum 16 upon on a drum shaft on which the winch line is spooled and unspooled and a controlling gear 20 on the drum shaft cooperating with the drum 16; a control assembly supported by the side plates 14 on a control shaft and engaging with the controlling gear 20 to rotate the drum 16 for spooling of the winch line on and off and holding the tension on the winch; a torque plate 100 (discussed below and shown in FIGS. 3-6) coupled to the control shaft and having at least one drive socket 106, wherein rotation of the torque plate 100 causes rotation of the control shaft and of the controlling gear 20 and the drum 16, a handheld battery operated powered tensioning and payout unit 110 (discussed below and shown in FIGS. 2 and 4-6) having at least one socket drive member 112 matching the at least one drive socket 106 of the torque plate 100, wherein operation of the unit 110 when the at least one socket drive member 112 is received within the at least one drive socket 106 of the torque plate 100 causes rotation of the torque plate 100 and consequent spooling or unspooling of the winch line on the drum 16.

Spooling of the winch line onto the drum 16 is a term used interchangeably herein with tensioning of the winch line, take up of the winch line, or winding of the winch line onto the drum. Unspooling of the winch line from the drum 16 is a term used interchangeably with paying-out or un-tensioning or unwinding of the winch line from the drum 16.

Figure 2:
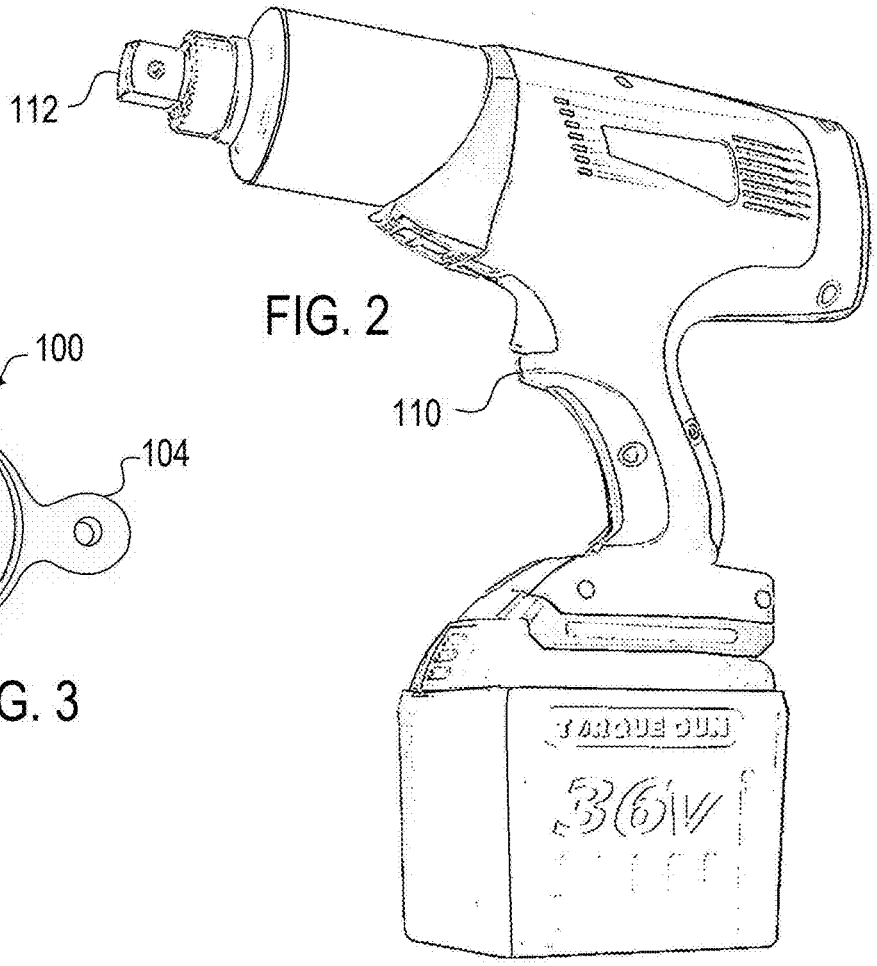
FIG. 2 is a perspective view of a handheld battery powered tensioning and payout unit according to one embodiment of the present invention.

FIG. 2 is a perspective view of a handheld battery powered tensioning and payout unit 110 according to one embodiment of the present invention. This unit 110 may be efficiently formed as a 700 ft lb torque driver with a ¾" socket drive member 112. The unit 110 of FIG. 2 corresponds to the torque plates 100 of FIG. 3 or 4 having a single central drive socket 106. FIG. 5 shows an embodiment of the unit 110 in which the unit 110 includes an annular array of socket drive members 112 that correspond to the torque plate 100 of FIG. 5 having an annular array of drive sockets 106. The operation and charging of the unit 110 is believed to be known to those of ordinary skill in the art. The unit 110 is drivable in two directions for tensioning and paying out the winch 10.

The invention additionally provides that the handheld battery operated powered tensioning and payout unit 110 includes a reaction arm 120 (not shown in FIG. 2) configured to extend from the unit 110 and prevent rotation of the unit 110 during rotation of the torque plate 100. The reaction arm 120 allows for easy one handed operation of the winch 10. Without the reaction arm 120 the user would need to withhold the reaction force of the winch line tension that would otherwise extend through the unit 110 in operation, making operation considerably more difficult. The reaction arm can be configured to engage any structure to prevent the counter rotation of the unit 110, such as the ground. However having a stop 122 engaging the housing is preferable and particularly engaging a receiving opening 124 in the side plate 14 of the housing receiving the stop 122 is most convenient.

FIG. 3 is a perspective view of a torque multiplier adaptor plate 100 according to one embodiment of the present invention that is designed for attachment to a hand wheel 24 of a winch 10. As discussed above it is conventional for a winch 10 to include wherein the control assembly that extends through one side plate 14 and includes a hand wheel 24 on the control shaft used for manually operating the winch 10 and to include an actuating lever 26 (also called a handle) which co-operate with the control shaft used for manually operating the winch 10. The torque plate 100 of FIG. 3 includes an array of three coupling members 104 to allow the plate 100 to be bolted to the hand wheel 24 of a winch 10 with the operation via the central drive socket 106 as shown in FIG. 6.

FIG. 5 is a perspective view of a torque multiplier adaptor plate 100 with a handheld battery powered tensioning and payout unit 110 according to one embodiment of the present invention which, as noted above, unit 110 includes an annular array of socket drive members 112 that correspond to the torque plate 100 of FIG. 5 having an annular array of drive sockets 106. The plate 100 here includes a coupling member 104 in the form of a keyed shaft receiving slot such that the plate 100 maybe keyed directly to the control shaft of the winch 10. The torque adaptor plate 100 shown in FIG. 5 could be attached to either end of the control shaft or formed as a replacement for the hand wheel 24 (or the drive sockets 106 formed into the hand wheel 24).

FIG. 4 shows a torque multiplier adaptor plate 100 with a single central drive socket 106 and which is coupled directly to the control shaft. The inner portion of the plate 100 includes the coupling member 104 keying the plate 100 to the control shaft while the outer portion of the plate includes the central drive socket 106 as shown.

From the above it is apparent that the present invention provides an apparatus for retrofitting manual winches 10 comprising: a torque plate 100 (such as shown in FIG. 3-6) configured to be coupled to a control shaft of a manual winch 10 and having at least one drive socket 106, wherein rotation of the torque plate 100 once coupled to the control shaft of the winch 10 would be configured to cause rotation of the control shaft and of a controlling gear and a drum of the winch 10, and a handheld battery operated powered tensioning and payout unit 110 having at least one socket drive member 112 matching the at least one drive socket 106 of the torque plate 100, wherein operation of the unit 110 when the at least one socket drive member 112 is received within the at least one drive socket 106 of the torque plate 100 and the torque plate 100 has been coupled to a control shaft of a winch 10, causes rotation of the torque plate 100 and consequent spooling or unspooling of the winch line on the drum 16. The apparatus allows for easy conversion of a prior manual winch 10 to a winch 10 that selectively utilizes a handheld battery operated powered tensioning and payout unit 110.

The apparatus for retrofitting a manual winch of the present invention includes wherein the handheld battery operated powered tensioning and payout unit 110 includes a reaction arm 120 configured to extend from the unit 110 and prevent rotation of the unit 110 during rotation of the torque plate 100. The reaction arm 120 of the handheld battery operated powered tensioning and payout unit 110 may include a stop 122 engaging with the housing of the winch 10, specifically, wherein a side plate 14 of the winch 10 incudes a recess 124 engaging the stop 122 of the reaction arm 120.

The present invention provides a simple method for retrofitting manual winches 10 to be operable with handheld battery powered tensioning and payout unit 110 comprising the steps of: coupling a torque plate 100 having at least one drive socket 106 to a control shaft of a manual winch 10 whereby rotation of the torque plate 100 once coupled to the control shaft of the winch 10 would be configured to cause rotation of the control shaft and of a controlling gear 20 and a drum 16 of the winch 10 for tensioning and paying out the winch line, and providing a handheld battery operated powered tensioning and payout unit 110 having at least one socket drive member 112 matching the at least one drive socket 106 of the torque plate 100, wherein operation of the unit 110 when the at least one socket drive member 112 is received within the at least one drive socket 106 of the torque plate 100 and the torque plate 100 has been coupled to a control shaft of a manual winch 10, causes rotation of the torque plate 10 and consequent spooling or unspooling of the winch line on the drum 16. The method for retrofitting manual winches according the invention may further include providing a reaction arm 120 configured to extend from the unit and prevent rotation of the unit during rotation of the torque plate. The reaction arm 120 may include a stop 122 and the method further include providing a matching opening 124 in a side plate 14 of the winch 10 to receive the stop 122 in operation.

In tensioning operation of the winch 10 of the present invention the user can use the hand wheel 24 for rapid take up, then move to the use of the ratchet handle or lever 26 for subsequent tensioning of the winch line of the winch 10. The final tensioning is through use of the unit 110. The use of unit 110 assures an even appropriate tension on the winch line is applied to all winches 10 implementing the system. Further this eliminates the need for cheater bars that have resulted in numerous operator injuries.

In payout operations with the winch 10 of the invention the operator can use the traditional hand wheel 24 and brake as always. However the present invention allows for the unit 110 to be used (with rotation switched to the opposite of take-up or tensioning direction) to provide an even constant payout of the winch line that can be important for certain applications.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention should be defined by the appended claims and equivalents thereto.

What is claimed is:

1. A winch including:

a housing with side plates;

a rotatable spool assembly supported between the side plates on a drum shaft and including a drum upon on the drum shaft on which a winch line is spooled and unspooled and a controlling gear on the drum shaft cooperating with the drum;

a control assembly supported by the side plates on a control shaft and engaging with the controlling gear to rotate the drum for spooling of the winch line on and off and holding the tension on the winch, wherein the control assembly extends through one side plate and includes a hand wheel on the control shaft used for manually operating the winch;

a torque plate coupled to the control shaft and having at least one drive socket, wherein rotation of the torque plate causes rotation of the control shaft and of the controlling gear and the drum, a handheld battery operated powered tensioning and payout unit having at least one socket drive member matching the at least one drive socket of the torque plate, wherein operation of the unit when the at least one socket drive member is received within the at least one drive socket of the torque plate causes rotation of the torque plate and consequent spooling or unspooling of the winch line on the drum.

2. The winch according to claim 1, wherein the control assembly includes an actuating lever which co-operate with the control shaft used for manually operating the winch.

3. The winch according to claim 1, wherein the torque plate is coupled to the hand wheel.

4. The winch according to claim 1, wherein the torque plate includes one central drive socket.

5. The winch according to claim 1, wherein the torque plate is keyed onto the control shaft.

6. The winch according to claim 1, wherein the torque plate includes an annular array of drive sockets.

7. The winch according to claim 1, wherein the handheld battery operated powered tensioning and payout unit includes a reaction arm configured to extend from the unit and prevent rotation of the unit during rotation of the torque plate.

8. The winch according to claim 7, wherein the reaction arm of the handheld battery operated powered tensioning and payout unit includes a stop engaging with the housing of the winch.

9. The winch according to claim 8, wherein a side plate incudes a recess engaging the stop of the reaction arm.

10. An apparatus for retrofitting manual winches comprising:

a torque plate configured to be coupled to a control shaft of a manual winch and having an annular array of drive sockets, wherein rotation of the torque plate once coupled to the control shaft would be configured to cause rotation of the control shaft and of a controlling gear and a drum of the winch, and a handheld battery operated powered tensioning and payout unit having an annular array of socket drive members matching the annular array of drive sockets of the torque plate, wherein operation of the unit when the annular array of socket drive members are received within the annular array of drive sockets of the torque plate and the torque plate has been coupled to the control shaft of a manual winch, causes rotation of the torque plate and consequent spooling or unspooling of the winch line on the drum.

11. The apparatus for retrofitting manual winches according to claim 10, wherein the control assembly extends through one side plate and includes a hand wheel on the control shaft used for manually operating the winch, and wherein the torque plate is configured to be coupled to the hand wheel.

12. The apparatus for retrofitting manual winches according to claim 10, wherein the torque plate is keyed whereby it may be keyed onto the control shaft.

13. The apparatus for retrofitting manual winches according to claim 10, wherein the handheld battery operated powered tensioning and payout unit includes a reaction arm configured to extend from the unit and prevent rotation of the unit during rotation of the torque plate.

14. The apparatus for retrofitting manual winches according to claim 13, wherein the reaction arm of the handheld battery operated powered tensioning and payout unit includes a stop engaging with the housing of the winch.

15. The apparatus for retrofitting manual winches according to claim 14, wherein a side plate incudes a recess engaging the stop of the reaction arm.

* * * * *